US005303526A

United States Patent [19]

Niese

[11] Patent Number: 5,303,526

[45] Date of Patent: Apr. 19, 1994

[54] RESILIENT PORTABLE FLOOR SYSTEM

[75] Inventor: Michael W. Niese, Cincinnati, Ohio

[73] Assignee: Robbins, Inc., Cincinnati, Ohio

[21] Appl. No.: 8,721

[22] Filed: Jan. 21, 1993

Related U.S. Application Data

[63] Continuation-in-part of Ser. No. 844,466, Mar. 2, 1992, which is a continuation-in-part of Ser. No. 769,157, Sep. 27, 1991, abandoned, which is a continuation of Ser. No. 459,198, Dec. 29, 1989, abandoned, which is a continuation-in-part of Ser. No. 308,243, Feb. 8, 1989, Pat. No. 4,890,434.

[51] Int. Cl.[5] ..... E04F 13/08

[52] U.S. Cl. ..... 52/393; 52/480; 52/396.05

[58] Field of Search ..... 52/393, 390, 403, 408, 52/480, 391, 782; 248/634, 635; 267/153

[56] References Cited

U.S. PATENT DOCUMENTS

| | | |
|---|---|---|
| 1,477,331 | 12/1923 | Ely . |
| 2,088,238 | 7/1937 | Greenway . |
| 2,477,071 | 7/1949 | Matti et al. . |
| 2,569,709 | 10/1951 | Elmendorf . |
| 2,634,464 | 4/1953 | Storm et al. . |
| 2,893,665 | 7/1959 | Paulsen . |
| 2,919,476 | 1/1960 | Fritz . |
| 3,107,377 | 10/1963 | Nathan . |
| 3,273,296 | 9/1966 | Soulon . |
| 3,279,138 | 12/1961 | Dittmar . |
| 3,288,405 | 11/1966 | Johnson . |
| 3,337,167 | 8/1967 | Johnson . |
| 3,368,806 | 2/1968 | Szonn . |
| 3,417,950 | 12/1968 | Johnson . |
| 3,579,410 | 5/1971 | Barrett . |
| 3,579,941 | 5/1971 | Tibbals . |
| 3,908,053 | 9/1975 | Hettich . |
| 4,682,459 | 7/1987 | Stephenson . |
| 4,879,857 | 11/1989 | Peterson et al. . |
| 4,890,434 | 1/1990 | Niese ..... 52/393 |

FOREIGN PATENT DOCUMENTS

| | | |
|---|---|---|
| 240020 | 5/1965 | Austria . |
| 485372 | 8/1952 | Canada . |
| 565012 | 10/1958 | Canada . |
| 675982 | 12/1963 | Canada . |
| 1157367 | 11/1960 | Fed. Rep. of Germany . |
| 1255900 | 7/1967 | Fed. Rep. of Germany . |
| 2053588 | 5/1972 | Fed. Rep. of Germany . |
| 2221761 | 11/1973 | Fed. Rep. of Germany . |
| 2609792 | 9/1977 | Fed. Rep. of Germany . |
| 427830 | 11/1947 | Italy . |
| 557430 | 2/1957 | Italy . |
| 353158 | 5/1955 | Switzerland . |
| 835758 | 5/1960 | United Kingdom . |

*Primary Examiner*—Carl D. Friedman
*Assistant Examiner*—Creighton Smith
*Attorney, Agent, or Firm*—Wood, Herron & Evans

[57] ABSTRACT

A portable hardwood floor system of interconnected floor sections supported in spaced relation over a substrate includes a plurality of mounts attached to the bottoms of each of the interconnectable sections. Each mount includes a resilient pad to resiliently support the portable floor system above the base and a glide member located below the pad. The glide members are substantially noncompressible under normal floor loading conditions and have a relatively low coefficient of friction with respect to the base. The glide members are slidable on the base to enhance maneuverability in positioning and aligning the interconnectable floor sections, thereby to facilitate interconnection of the sections to form the floor system. The glide members also protect the portable floor section and/or the base and are also sufficiently durable to withstand frequent handling commonly required of a portable hardwood floor system.

17 Claims, 4 Drawing Sheets

RESILIENT PORTABLE FLOOR SYSTEM

This application is a continuation-in-part application based upon applicant's U.S. patent application Ser. No. 07/844,466, filed on Mar. 2, 1992, and entitled "KERFED HARDWOOD FLOOR SYSTEM", which is a continuation-in-part application of application, Ser. No. 769,157, filed on Sep. 27, 1991 now abandoned and entitled "Kerfed Hardwood Floor System", which is a continuation of application Ser. No. 459,198, filed on Dec. 29, 1989 now abandoned and entitled "Kerfed Hardwood Floor System", which is a continuation-in-part application of application Ser. No. 308,243, filed on Feb. 8, 1989 and issued on Jan. 2, 1990 as U.S. Pat. No. 4,890,434, entitled "Hardwood Floor System".

FIELD OF THE INVENTION

This invention relates to hardwood floor systems and more particularly, to a portable hardwood floor system commonly used in multi-purpose facilities.

BACKGROUND OF THE INVENTION

Large capacity facilities or arenas are generally used for a variety of entertainment and athletic purposes. When one of these purposes is basketball, a portable hardwood floor must be placed on top of the base floor, which may be concrete, plywood, a synthetic surface or even ice.

Most portable hardwood floors comprise a plurality of interconnected 4'×4' or 4'×8' rectangularly shaped sections. Typically, each section includes an upper wear surface of elongated, hardwood maple floorboards or a plurality of maple parquet elements arranged in a rectangular configuration. One or more subfloor layers may be used to support the wear surface, with the one or more layers being elongated sleepers which may be either narrow or relatively broad. One or more subfloor layers of panels may be used to simulate one of the desired qualities of a permanent hardwood floor system, i.e., dimensional stability. In either case, the lowermost subfloor layer is supported directly on the base.

One common problem associated with portable floor systems of this type relates to interconnection and disconnection of the rectangular sections before and after an event for which the floor is needed, such as before and after a basketball game. Each section must be connected in flush, perimeter engagement with the other, adjacently situated sections. This requires initial placement and connection of a first row of floor sections, followed by row by row placement, maneuvering and interconnection of the other sections with the already connected sections. During this process, frictional forces between the bottom surfaces of the sections and the arena floor make placement and maneuvering difficult, time consuming and labor intensive. Typically, installers must hit the sides of the floor sections with a large rubber mallet to move them into proper position. Over a period of time, impact from the mallet will cause wear and tear along the edges of the floor sections.

Additionally, the direct contact of a bottommost subfloor layer with the base may cause damage to the base, particularly if the base is wood or synthetic. At the very least, a base of this type must be covered for protection. If the base is ice, direct contact therewith causes some melting and water transfer to the floor sections, thereby making them heavier and accelerating deterioration.

If the sections of the portable floor system are supported on rubber pads to provide resilience for the floor system, friction between the floor sections and the base is further increased, and this increased friction inhibits the lateral maneuverability of the sections. Thus, while some resiliency for the final floor is achieved, installation becomes inconvenient, resulting in higher costs. This increased friction may loosen or knock some of the pads off of the bottoms of the floor sections. Also, the increased friction will necessitate increased use of the mallet to move the floor sections into position, thereby accelerating the wear and tear caused by mallet use. The frequent handling of the portable sections also knocks pads from the bottoms of the sections. With some pads missing, the resiliency will not be uniform. Thus, the increased friction caused by bottom-mounted pads results in inconvenience during installation and a decrease in the uniformity of resiliency for the portable floor.

Koller U.S. Pat. No. 4,860,516 discloses a portable floor system which includes compressible pads located between upper and lower spaced subfloor layers. The spaced subfloor layers protect the pads and prevent them from being rubbed off the bottoms of the sections during lateral movement on the base floor.

However, due to the increased surface contact between the lower surfaces of the bottommost layer of the sections and the base floor, and the increased friction which results therefrom, these sections are difficult to move laterally along the base into alignment with already connected floor sections. Thus, while the pads are protected, this advantage is accompanied by a corresponding increase in the difficulties associated with maneuvering the floor sections into alignment during connection. Moreover, this particular floor has a relatively high vertical dimension, which represents a safety hazard around the edge unless an inclined perimeter is mounted thereto. Such a perimeter represents an added cost in material, labor and storage.

It is an objective of this invention to facilitate the interconnection of a plurality of interconnectable sections of a resilient portable hardwood floor system.

It is another objective of this invention to improve the dimensional stability, the resiliency and the uniformity in resiliency of a portable hardwood floor system, and at the same time to reduce the difficulties presently associated with maneuvering, aligning and interconnecting the floor sections of such a system, and to reduce safety problems and/or higher costs caused by a high vertical dimension.

It is still another objective of the invention to improve the resiliency of a portable hardwood floor system in a manner such that the resilient support means is neither susceptible to excessive wear and tear during frequent handling nor disadvantageous during installation.

The objectives of this invention are achieved by a portable floor system comprising a plurality of interconnectable sections, each of the floor sections supported by a plurality of mounts which include non-compressible, low friction glide members in direct contact with the base.

The non-compressible, low friction glide members enable the floor sections to be relatively easy to maneuver and slide into alignment for interconnection. Thus, because this invention reduces friction between the floor sections and the base, it represents an improvement over portable floors which include a subfloor in direct contact with the base.

Due to the reduced co-efficient of friction of the glide members with respect to the base, and because of their rigidity, the mounts are also substantially less likely to be knocked off the bottom of the sections during lateral movement, compared to unprotected rubber pads. Moreover, the reduced friction reduces the need to hit the sides of the floor sections with a rubber mallet to move them into proper position.

Preferably, the mounts are vertically compressible, and the compressibility of the mounts provides resiliency for the interconnected sections of the portable floor system, regardless of whether the base is concrete, wood, synthetic or even ice. The use of a plurality of mounts to support the floor sections above the base further reduces friction by reducing the surface area of contact with the base. Additionally, if the base is ice, the mounts eliminate water transfer to the floor sections.

According to a first preferred embodiment of the invention, each portable floor section has a wear surface of floorboards, at least one subfloor layer and a plurality of mounts which comprise compressible and deflectable pads secured to the lower surface of the bottommost subfloor. The pads have a truncated conical shape, with a base portion of the conical shape secured to the lower surface of the bottommost subfloor layer and an apex portion extending downwardly therefrom. There is no vertically continuous line of material between the base portion and the apex portion. Also, under no load conditions, the surface area of contact of the base portion with the subfloor is removed laterally from the surface area of contact of the apex portion with the concrete.

A nylon glide member or tip is embedded in the apex portion of each of the pads. The glide member is slidable with respect to the concrete base which is typically used in multi-purpose arenas. Thus, the glide member reduces the co-efficient of friction of the portable floor section with respect to the base.

According to a second preferred embodiment of the invention, each of the interconnected sections of a portable floor system is supported by a plurality of compressible mounts which comprise a compressible and deflectable pad encased within an opposed pair of vertically aligned and interconnected cups. Each pair of cups forms a encasement which encases a respective pad. The upper cups are attached to the lower surface of the bottommost subfloor layer and open downwardly. The lower cups open upwardly and receivably interlock with the upper cups, with a pad held therein. Preferably, the pad has a truncated conical shape.

Once connected, the cups may move toward each other along the axis of connection, upon impact to floorboards above. The amount of movement is determined by the compressible and deflectable characteristics of the pad. Also, the sizing of the cups provides an automatic stop mechanism for limiting vertical deflectability to a predetermined distance, which is preferably about 5/16". When the pad is located inside the two interconnected caps, with no compressive force applied to the cups, the pad is not compressed. Stated another way, the cups move away from each other to a distance which is equal to or slightly greater than the vertical dimension of the pad.

Upon impact to the floorboards thereabove, the pads compress vertically to allow relative vertical movement between the interconnected cups, thereby providing resiliency for the portable floor system. Because of the vertical dimension of the pad with respect to the inside of the cups, deflection is high at impact, but deflection is confined to a relatively small surface area of the floorboards. Perhaps most importantly, the low friction composition of the cups, which are preferably nylon, allows the floor sections to slide relatively easily over the concrete base to facilitate maneuvering and alignment during interconnecting of a plurality of portable floor sections.

In a variation of this embodiment, the upper cups may be partially embedded or countersunk within the lowermost subfloor layer. This reduces the overall height of the floor sections, thereby reducing the volume of space required for storing and reducing safety concerns and/or the cost of an inclined perimeter, both of which are associated with high profile floors.

For each embodiment, compared to portable floor sections equipped with either a planar bottom layer in direct contact with the base, or a plurality of rubber pads in contact with the base, the rigid, low friction glide members reduce the co-efficient of friction between the floor sections with respect to the base. If the glide members are nylon, the floor sections maintain their slidability, due to the somewhat self-lubricating nature of nylon.

With a plurality of compressible mounts supported and carried by the lower surface of the bottommost subfloor, the subfloor of each section of the floor system is raised above the base. Thus, it is easy for individuals to grasp, lift, maneuver and carry the sections during connection and disconnection.

Additionally, for a floor system wherein the floor sections have sleepers on the bottom and in which the mounts are partially countersunk in the floor sections, spacing blocks may be secured between the sleepers, in perpendicular orientation thereto, to assist stacking of sections in a manner which does not apply any compressive load to the mounts.

For each embodiment, to further confine the total surface area of deflection under impact from above, as explained in all of applicant's preceding related applications, kerfs may be provided in one or more of the subfloor surfaces and/or the bottom surface of the floorboards.

These and other features of the invention will be more readily understood in view of the following detailed description and the drawings.

DETAILED DESCRIPTION OF THE DRAWINGS

Figure 1:
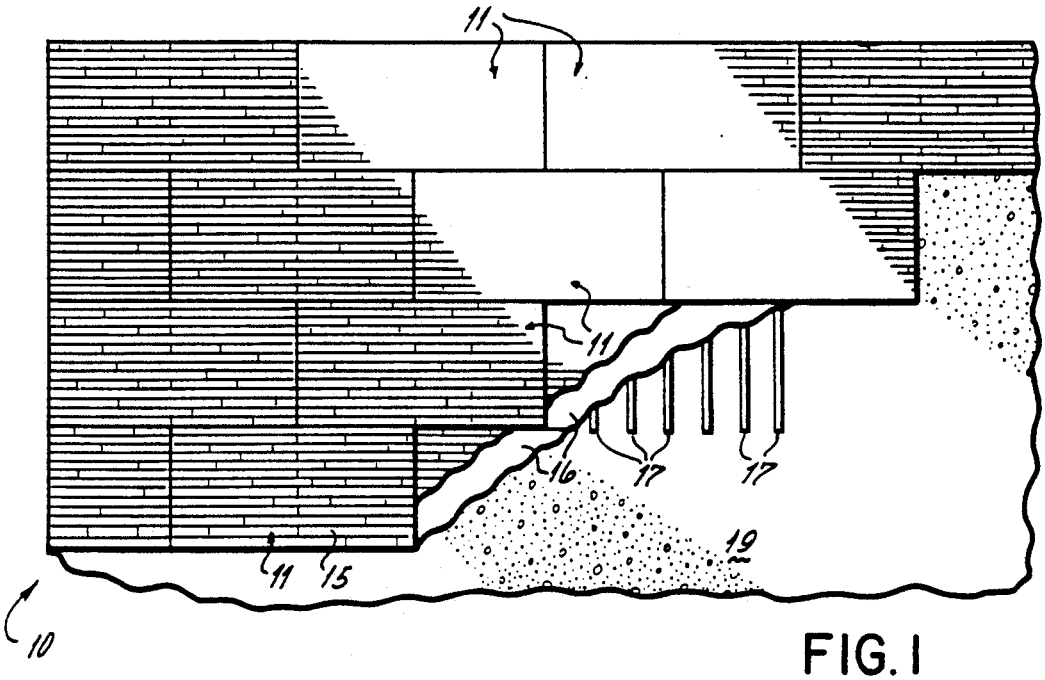
FIG. 1 is a plan view of a portion of a portable floor system of interconnected, rectangularly shaped floor sections.

FIG. 1 is a plan view showing a portable hardwood floor system 10 comprising a plurality of rectangularly shaped connectable sections or modules 11. Typically, the floor sections 11 are either 4'×8' or 4'×4', with the 4'×4' sections located at the ends of the rows of floor sections 11 to provide a staggered arrangement. Typically, the portable hardwood floor system must cover a surface area which is about 112'×60'.

The sections 11 of the portable hardwood floor system 10 are stored when not in use. When in use, the sections 11 are interconnected on top of a smooth base floor or substrate, which may be concrete, wood, synthetic or even ice. Applicant's U.S. Pat. No. 3,967,428 discloses structural details for interconnecting a plurality of portable floor sections 11 and is expressly incorporated by reference herein, in its entirety. Alternately, the floor sections may be interconnected in a manner identical to a current method used to interconnect a portable floor system sold by the assignee of this application under the trademark Cincinnati All-Star Portable.

The present invention relates to a portable floor system 10 equipped with a plurality of resilient mounts secured to a bottom surface of the floor sections 11 for supporting the portable floor 10 in spaced relation above the base. The present invention does not relate particularly to the interconnection of the perimeter edges of the floor sections 11.

Figure 2:
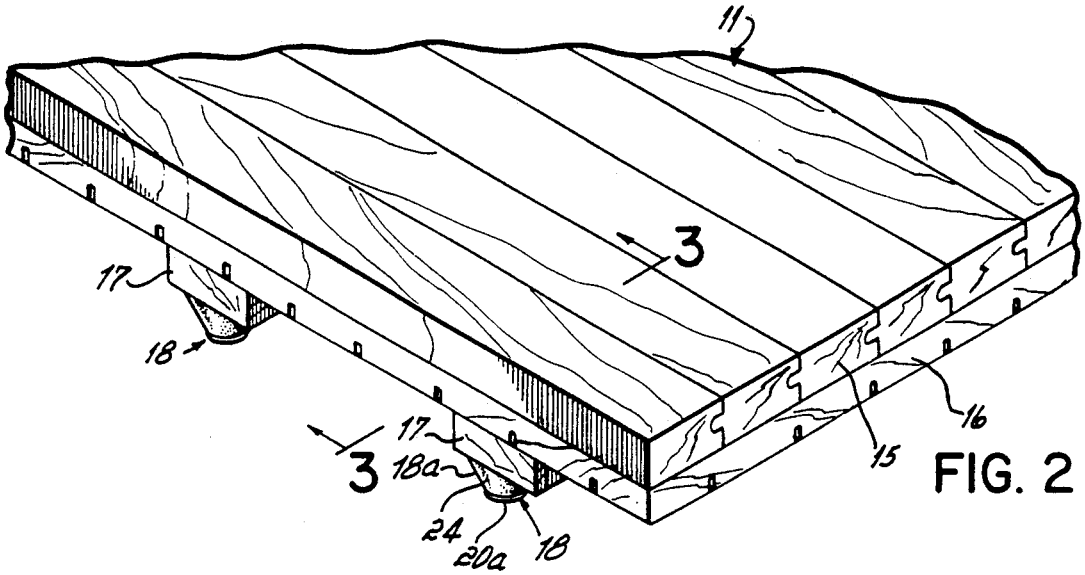
FIG. 2 is a fragmentary perspective view of one rectangular floor section of a portable floor system, the floor section equipped with a plurality of resilient mounts formed according to a first preferred embodiment of the invention.

FIG. 2 shows a portion of a single rectangularly shaped floor section 11. According to a preferred construction, the floor section 11 includes a wear surface 15 of hard maple floorboards laid end to end, with adjacent rows staggered. Preferably, within each section 11, the floorboards 15 of adjacent rows are interfitted via a tongue and grove connection. Alternatively, the wear surface 15 may comprise a plurality of smaller parquet elements arranged in a configuration designed to occupy the same total surface area as the floorboards.

Figure 3:
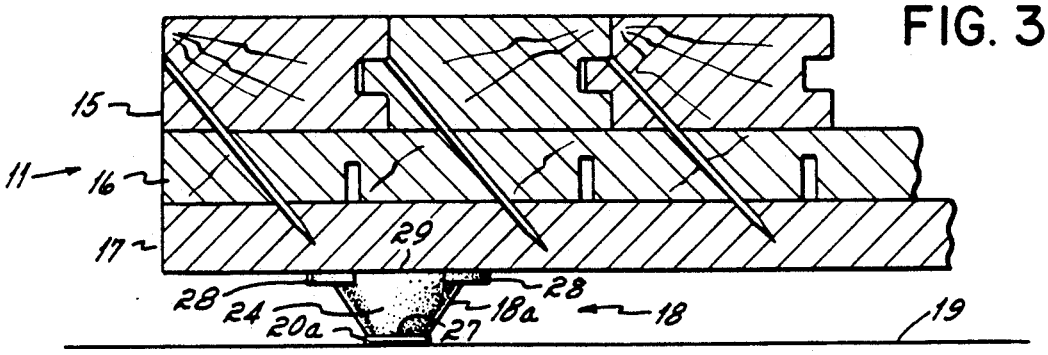
FIG. 3 is a cross-sectional view taken along lines 3—3 of FIG. 2.

FIGS. 2 and 3 show an upper subfloor 16 of wooden panels residing beneath the wear surface 15, and a lower subfloor 17 of narrow, spaced sleepers residing beneath the upper subfloor 16. Alternatively, it may be desirable to provide only one subfloor layer. Preferably, for each floor section 11, the upper subfloor 16 comprises a single sheet of plywood with a thickness of ½" to ¾". The upper subfloor 16 and the lower subfloor 17 may be secured together, either by adhesive or mechanical fasteners, such as staples, nails, etc. The floorboards 15 are secured to the upper subfloor 16 and the lower subfloor 17 by nails driven downwardly at an angle, with the nails driven into the floorboards 15 at the tongues. If both subfloors 16 and 17 are made of panels, to interconnect the floor sections 11 some edge portions of subfloor 16 and/or subfloor 17 may be cut away to accommodate the connecting mechanisms. If either subfloor 16 or 17 is made of narrow, spaced sleepers, the connecting mechanisms may be mounted to the sides of the sleepers, or in between the sleepers.

As disclosed in applicant's related applications, which are specifically identified above, one or more of: i) the bottom surface of the wear layer 15; ii) the top and bottom surfaces of the upper subfloor 16, and iii) the top and bottom surfaces of the lower subfloor 17 may be kerfed to attenuate the total surface area of deflection upon impact of a load to the floorboards 15. If the floorboards 15 are kerfed, the kerfs should be oriented transverse to the direction of elongation. If both the upper subfloor 16 and the lower subfloor 17 are kerfed, it is preferable that the kerfs of the subfloors 16 and 17 intersect each other.

A plurality of mounts, designated generally by reference numeral 18, support the floor section 11 in spaced relation above the base 19, as shown most clearly in FIG. 3. Preferably, the mounts 18 are spaced about one every square foot, and they are secured to a lower surface of the bottommost subfloor 17. This provides uniformity in support and/or resiliency. Each mount 18 includes, at its bottom, a glide member, designated generally by reference numeral 20, which is substantially noncompressible under normal floor loading conditions.

The glide members 20 also have a relatively low coefficient of friction with respect to the concrete base 19. This enhances maneuverability in positioning and aligning the floor sections 11, thereby facilitating interconnection when forming the composite portable floor system 10. In one test, applicant learned that a floor section 11 equipped with the glide members 20 requires less than half as much force to move laterally. More specifically, on a wood surface, a floor section with no glide member required about 78–80 pounds of horizontally directed force to begin moving, while a floor section 11 equipped with a glide member 20 required only about 38 pounds of force. In addition to facilitated interconnection of the panels 11, the slidable guide members 20 are rigid enough to protect the rubber material of a pad 24 during interconnection and disconnection of the floor sections 11.

Figure 4:
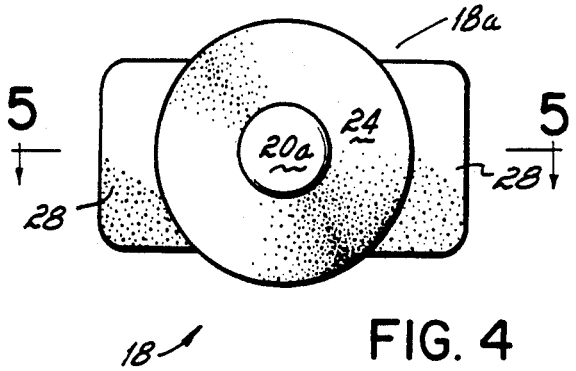
FIG. 4 is a bottom view of a mount of the type shown in FIG. 3.
Figure 5:
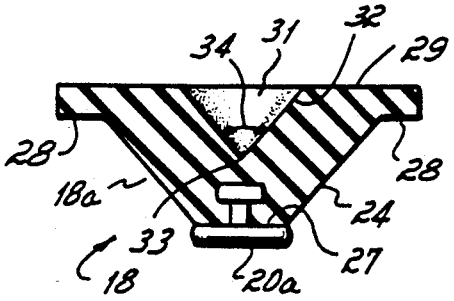
FIG. 5 is a cross-sectional view taken along lines 5—5 of FIG. 4.

According to a first preferred construction of the invention, which is shown in FIGS. 3, 4 and 5, the resilient mounts 18*a* include the compressible and deflectable rubber pad 24 which has a truncated conical shape. The pad 24 has a flat apex portion 27 spaced from a flat base portion 29. Preferably, the flat base portion 29 also includes an opposing pair of ear 28 which facilitate attachment of the pad 24 to the lower surface of the bottommost subfloor layer 17. Preferably, the pad 24 is made of ethylene propylene rubber with a hardness ranging from about 45 to 80 durometer on the Shore A scale. Although any other elastomeric or compressible, moldable material would also be sufficient, ethylene propylene is preferred because it is not susceptible to excessive degradation over a period of time.

As shown in FIG. 5, each of the pads 24 has an internal hollow volume 31 located at base portion 29. The hollow volume 31 has a cross-sectional area that decreases from base portion 29 to apex portion 27. Preferably, the cross-sectional area of the hollow volume 31 is greatest at base portion 29 and decreases in the direction of apex portion 27. Volume 31 occupies less space than the remainder of the pad 24. The pad 24 shown in FIG. 5 occupies about 0.645 cubic inches, while volume 31 occupies about 0.043 cubic inches, or about 6.7% of the pad 24 volume. While it is preferable that this volume ratio be about 5% to 15%, it may extend up to 30% or higher, depending on the hardness of the material used to form the pad 24.

Also, as shown in FIG. 5, the hollow volume 31 is preferably conical in shape, with a downwardly directed apex 33 located at the intersection of interior sidewalls 32. The sidewalls 32 define an angle 34 which is preferably about 110°. It is noted that there is no coextensive surface contact area between apex portion 27 and base portion 29. That is, no point of surface contact of base portion 29 with subfloor 17 is vertically aligned with any point of surface contact of apex portion 27 with glide member 20*a*. Moreover, there exists no solid or uninterrupted vertical line of rubber material extending from apex portion 27 to base portion 29 when the pad 24 is in an unloaded condition.

This combination of features ensures that the pads 24 deflect initially upon impact to the floorboards 15 above, with no initial compression. Immediately thereafter, deflection distorts the shape of the pads 24 so that there is some portion of the pad 24 where a solid vertical line of rubber material extends between apex portion 27 and base portion 29. At this point, this line of material must be compressed in order to provide additional vertical deflection at the top surface of the floorboards 15 upon impact thereto.

Due to the combination of deflection an compression, and in addition, the elastomeric material used, the pad 24 provides not only a high degree of reflection and resiliency for the floor system 10, but the pads 24 also provide a high degree of vibration dampening that cannot be achieved with any other so called "high deflection" hardwood floors.

As shown in FIGS. 3, 4 and 5, each of the mounts 18*a* is rendered slidable with respect to the base 19 by a glide member 20*a* located below apex portion 27. The glide member 20*a* is preferably made by molding, and is of a rigid material such as plastic or nylon, or any other durable material with a similarly low coefficient of friction with respect to concrete substrate 19. FIG. 5 shows that glide member 20*a* embedded within pad 24. This may be accomplished by forming the pad 24 by molding with the glide member 20*a* located in situ in the mold. Alternatively, the glide member 20*a* may be adhered to apex portion 27 with glue.

Because of the compressibility and deflectability of the rubber pads 24 used in the mounts 18*a*, each of the floor sections 11 has a high degree of resiliency and uniformity of resiliency. Moreover, due to the use of glide members 20*a* located at the bottoms of the rubber pads 24, the bottom mounted mounts 18*a* facilitate interconnection and disconnection of the floor sections 11 in a manner which does not inhibit resiliency and in a manner which is not susceptible to degradation as a result of frequent handling by installers. In short, because of the rigid or non-compressible glide members 20*a*, the mounts 18*a* will not be easily knocked off, and the floor sections 11 will not require excessive blows with a rubber mallet to move them into proper position.

Figure 6:
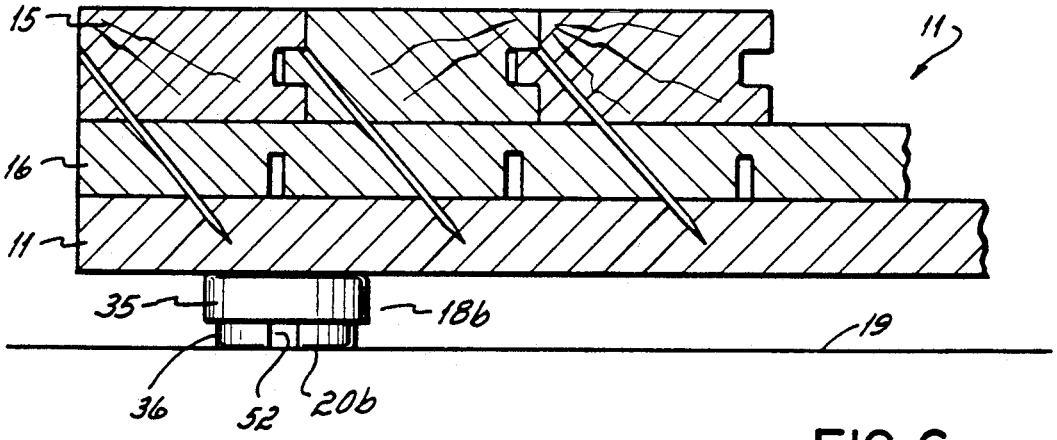
FIG. 6 is a cross-sectional view, similar to FIG. 3, showing a section of a portable floor system supported by a mount constructed in accordance with a second preferred embodiment of the invention.
Figure 7:
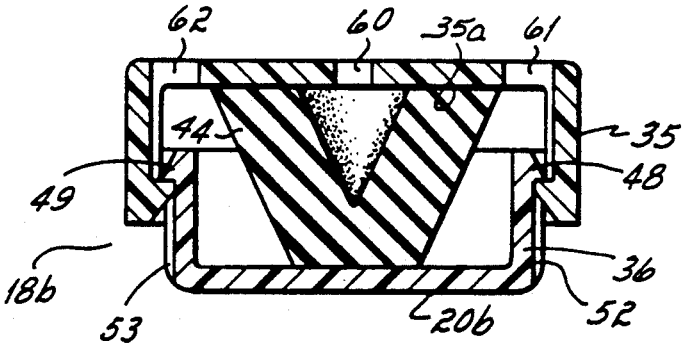
FIG. 7 is a cross-sectional view of the mount depicted in FIG. 6.
Figure 8:
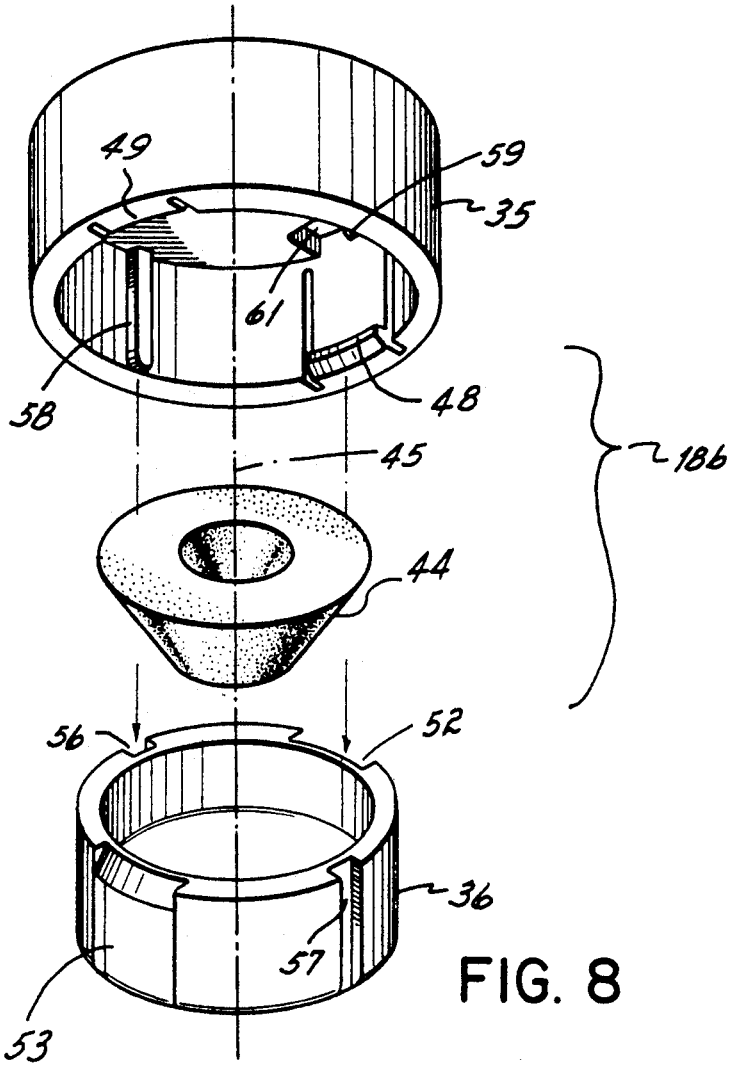
FIG. 8 is a disassembled perspective of the resilient mount shown in FIGS. 6 and 7.

FIGS. 6, 7 and 8 show a second preferred embodiment of the invention, wherein the floor sections 11 are supported in spaced relation above the concrete base 19 by mounts 18*b* which comprise a pair of releasably engagable cups 35 and 36. The cups 35 and 36 form an encasement of variable vertical dimension for housing and protecting a resilient pad 44 therein. The first cups 35 are attached to the lower surface of the bottommost subfloor 17 in downwardly opening orientation. The second cups 36 connect to the first cups 35 in upwardly opening orientation along an axis 45 of connection for the encasement. In the second embodiment, the bottom surface of cup 36 serves as the glide surface 20*b*. The cups 35 and 36 interconnect via a pair of opposed catches 48 and 49 formed in the first cup 35 which are received in a pair of corresponding, opposed channels 52 and 53, respectively, in the second cup 36. A second, smaller pair of opposed channels 56 and 57 in the second cups 36 receive elongated guides 58 and 59, respectively, formed on the inside surface of the first cups 35. This manner of releasably connecting the cups 35 and 36 prevents relative rotational movement about the axis 45 of the encasement while allowing relative vertical movement along the axis 45.

The latches 48 and 49 and the channels 52 and 53 define a maximum clearance dimension inside the encasement when there is no compression applied to the cups 35 and 36. The vertical dimension of the pad 44 is less than this maximum clearance dimension, so that it is not compressed by the interconnected cups 35 and 36 when no compressive force is applied to the cup 35 and 36. However, the vertical dimension of the connected 35 and 36 cups is reduced upon impact to the floorboards 15 thereabove. The amount of vertical movement depends upon the force applied to the floorboards 15, the compressible and deflectable characteristics of the pad 44 encased therein and the stop mechanism of the cups 35 and 36. The vertical dimension between the catches 48 and 49 and an inside top surface 35*a* of the first cup 35 dictates a distance of maximum vertical deflection. Stated another way, the top surface 35, the catches 48 and 49 and a top surface 36*a* of the second cup 36 act as a stop mechanism to limit vertical deflection.

Also, the pad 44 is preferably similar in shape to pad 24, i.e. a truncated cone, but pad 44 has no ears. The cups 35 and 36 are preferably molded of nylon or plastic, or another relatively rigid material with a somewhat self-lubricating capability and a low coefficient of friction with respect to base 19 of concrete, wood, synthetic or ice. Preferably, the cups 35 and 36 should have some resiliency to allow interconnection without requiring any tools, but sufficient rigidity to require a tool such as a screwdriver to separate the cups 35 and 36.

The first cups 35 preferably have a center hole 60 to allow mechanical connection to the bottom of subfloor 17, as by a staple or other suitable mechanical fastener. Side holes 61 and 62 may also be used to anchor, though they are actually necessary here to mold the upper cup 35. If desired, any of the holes 60, 61 or 62 may be tapered to limit protrusion of the mechanical fastener into the encasement. Preferably, a void 70 in the top of pad 44 is aligned with hole 60, so that if a nail or screw is driven or threaded through hole 60 to secure the first cup 35 to the lower subfloor 17, and the nail or screw does not remain flush with the top surface 35*a* of first cup 35, protrusion of the nail or screw into the encasement will not impair compressibility or deflectability of the pad 44.

Thus, the mounts 18*b* formed according to this construction of the invention provide resiliency for the portable floor system 10 upon impact to the floorboards 15, uniformity in resiliency, the durability necessitated by frequent interconnection and disconnection, and enhanced maneuverability for aligning the floor sections 11, thereby to facilitate interconnection.

While the second embodiment uses two interconnected cups which encase pad 44 in a cylindrically shaped encasement, other alternative encasement shapes or configurations would also be suitable, so long as the resilient pads 44 are carried by the lower surface of the bottommost subfloor 17 and the bottoms of the pads 44 ar protected by glide members 20*b* which have a low coefficient of friction with respect to the concrete base 19.

Another advantage of the second embodiment relates to the open volume between the encasing cups 35 and 36. This open volume may be occupied by a pad 44, as shown in the Figures, for most of the surface area covered by the floor system 10. However, for those areas of the floor system 10 which will bear something other than competing athletes, i.e. a ground-supported basketball goal, where vertical deflectability is not particularly desirable, the open volume between the cups 35 and 36 may be occupied by a more rigid material such as wood, hardened plastic, etc. Because each of the sections of a portable floor system 10 is always located in the same position of the overall floor system 10 and is always interconnected to the same adjacent sections 11, the encasing cups 35 and 36 can permanently contain these different materials.

Similarly, if desired, the pad 44 encased between the cups 35 and 36 may be changed to suit the activity for which the floor system will be used. For instance, a pad with lower compressible and/or deflectable characteristics may be used for volleyball, compared to basketball, and a pad with higher compression and/or deflection may be used for aerobics.

Figure 9:
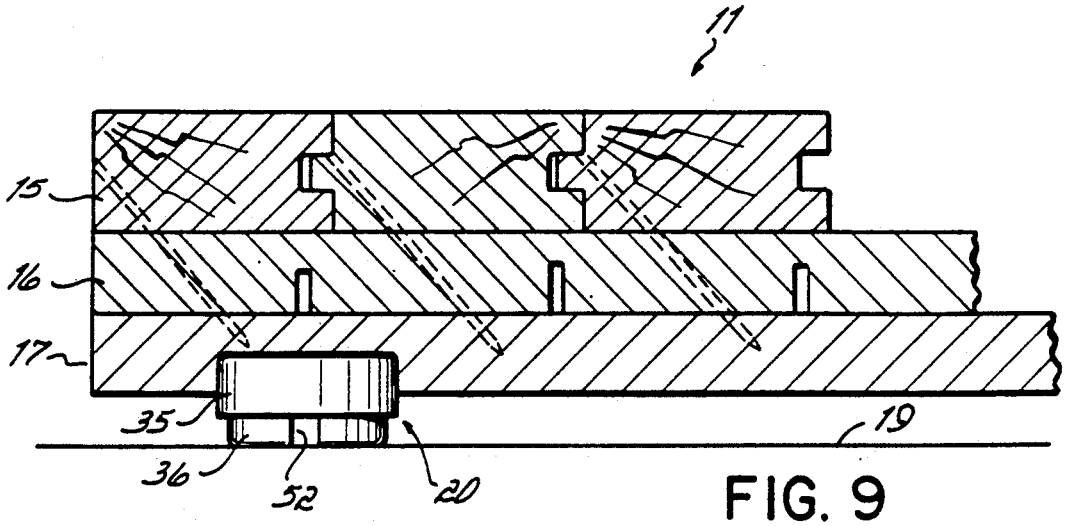
FIG. 9 is a cross sectional view, similar to FIG. 6, showing a variation of the second preferred embodiment of the invention.

FIG. 9 shows a mount 20 with a first cup 35 partially countersunk, or partially embedded into subfloor layer 17. Partial embedding protects the mounts 20 because a reduced amount of surface area is exposed. Also, when not in use, the overall height of the stacked sections 11 is less, so that less storage space is required.

For the embodiment of the invention shown in FIG. 9, another advantage arises out of the fact that each of the floor sections 11 of the interconnected floor system 10 is always located in the same position. Typically, the separate sections 11 are disconnected, loaded onto a cart in a stack, transported to a storage location, and then unloaded, or kept in a stack on the cart. If unloaded, an extra, time-consuming labor step is required. If kept in the stack, the mounts will be subject to vertical compression, an undesirable result because of potential for damage to the mounts, particularly if the mounts include compressible and/or deflectable pads. In the latter case, the pads will prematurely lose their springiness.

Figure 10:
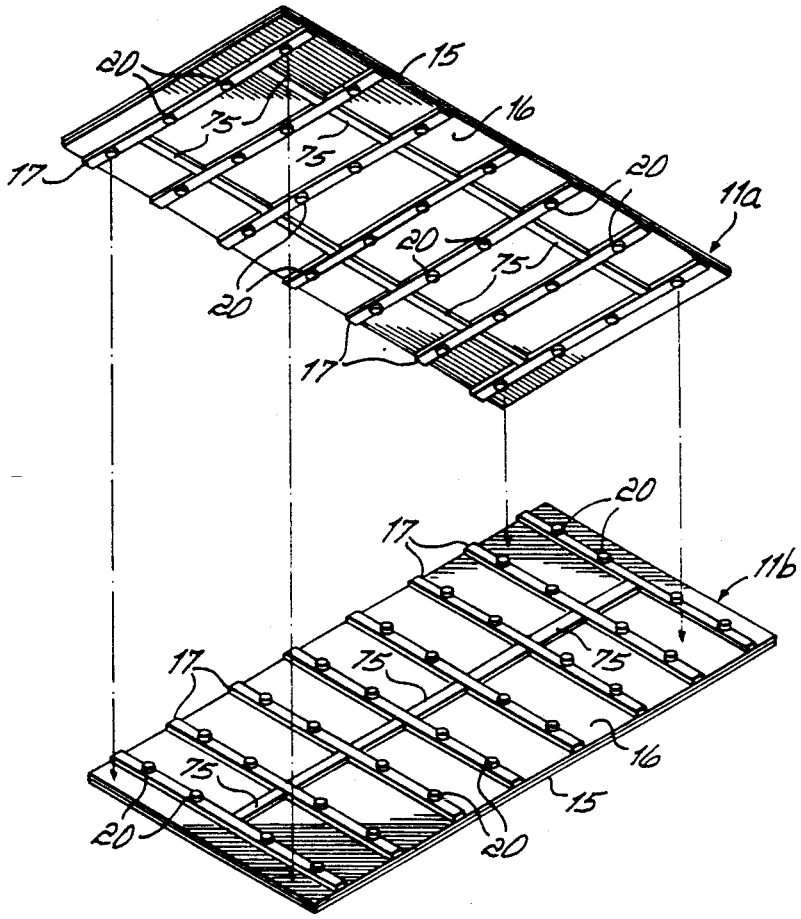
FIG. 10 is a bottom view of a floor section equipped with bottom mounted spacing blocks in accordance with another aspect of the invention.

The present invention solves this problem by providing spacing blocks 75 secured to the bottom of an upper subfloor 16, between parallel rows of narrow, spaced sleepers which form the lower subfloor 17, as shown in FIG. 10. The spacing blocks 75 are located away from the mounts 20, and they are arranged perpendicular to the sleepers of the subfloor 17. The spacing blocks 75 of adjacently situated floor sections 11 are staggered.

Figure 11:
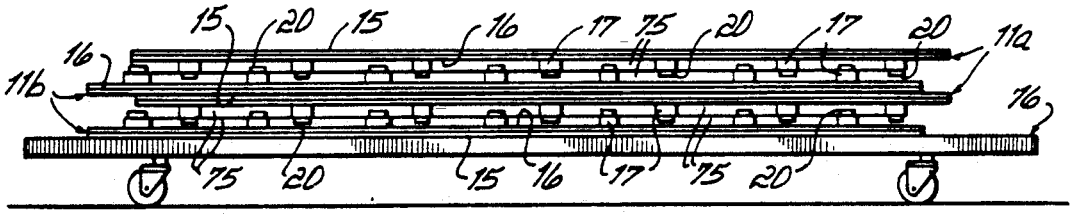
FIG. 11 is a cross sectional view through a plurality of floor sections of the type depicted in FIG. 10, with the sections stacked on a cart.

When stacked on a cart 76, as shown in FIG. 11, the floor sections 11 are always arranged such that top surfaces contact top surfaces and bottom surfaces contact bottom surfaces. By internally offsetting a first floor section 11*a* with respect to a lower, second floor section 11*b* upon which section 11*a* is stacked, as shown in FIG. 11, the sleepers of each of the sections 11*a* and 11*b* will be vertically supported by the spacing blocks 75 of the other one of the sections, 11*a* or 11*b*. More importantly, the mounts 20 are not subject to vertical compression forces from the weight of the rest of the stack of sections 11. As a result, the pads 24 or 44 are not held in compression. This aspect of the invention works particularly well if the mounts 10 are partially countersunk within a subfloor 17 of narrow, spaced apart sleepers and the vertical dimensions of the spacing blocks 75 are greater than the vertical protrusion of the mounts 20 from the bottom surface of the subfloor 17. However, this is not absolutely necessary. The spacing blocks 75 could be slightly thicker than the sleepers and still not interfere with downward deflectability when the floor system is in use.

The invention in its broader aspects is therefore not limited to the specific details, representative apparatus and methods, and illustrative examples shown and described. Accordingly, departures may be made from such details without departing from the spirit or scope of applicant's general inventive concept.

What is claimed is:

1. A portable hardwood floor system adapted to overlay a substrate comprising:

a plurality of portable sections, each of the sections including means adapted for operatively interconnecting the sections together to form an interconnected floor system;

a plurality of mounting means attached to a bottom surface of each of the sections for supporting the respective floor section in spaced relation above a base; and each of the mounting means including a glide member which is substantially non-compressible under normal floor loading conditions, each of the glide members having a relatively low coefficient of friction with respect to the base, thereby to enhance maneuverability in positioning and aligning the sections to facilitate interconnection thereof to form the floor system.

2. The portable floor system of claim 1 wherein each of the mounting means further comprises:

a vertically compressible pad having a truncated conical shape with an apex portion and a base portion.

3. The portable floor system of claim 2 wherein each said glide member is located at the apex portion of a respective pad.

4. The portable floor system of claim 1 wherein each of the mounting means further comprises:

a resilient pad with first and second spaced surfaces; and the respective glide further including encasement means for holding the respective pad below the bottom surface of the respective floor section.

5. The portable floor system of claim 4 wherein each said encasement means further comprises:

a pair of interconnected cups, a first of the cups secured to the lower surface of the respective floor section in downwardly opening orientation; and a second of the cups releasably connectable to the first cup in upwardly opening orientation to form an encasement with an axis oriented vertically when the floor system covers the substrate;

the respective pad residing within the encasement, one of the first and the second surfaces of the pad located adjacent an upper surface of the encasement and the other of the first and the second surfaces located adjacent a lower surface of the encasement; and the interconnected cups being movable toward each other along the axis to compress the pad held therebetween upon impact to a top surface of the interconnected floor system.

6. The portable hardwood floor system of claim 5 wherein the pad has a truncated conical shape and is both compressible and deflectable.

7. The portable hardwood floor system of claim 5 wherein, in an uncompressed state, the pad is not compressed by the interconnected cups.

8. The portable hardwood floor system of claim 5 wherein the encasement means further comprises:

stop means for limiting, to a predetermined dimension, movement of the interconnected cups toward each other.

9. The portable hardwood floor system of claim 5 wherein each of the upper cups is partially embedded within the bottom of the respective floor section.

10. A portable hardwood floor system adapted to overlay a base, comprising:

a plurality of portable sections, each of the sections including means adapted for operatively interconnecting the sections together to form an interconnected floor system;

means for resiliently supporting each of the sections above the base to provide a floor system that is deflectable upon the application of an impact force to the top surface thereof; and glide means located at the bottom of each of the floor sections, the glide means being substantially non-compressible under normal floor loading conditions and having a low coefficient of friction with respect to the base, thereby to enhance maneuverability in positioning and aligning the sections to facilitate interconnection thereof to form the floor system.

11. In a hardwood portable floor system including a plurality of interconnected sections supported in spaced relation over a base, the invention comprising:

a plurality of mounts attached to a bottom surface of each of the sections, each mount including a resilient pad to provide vertical deflectability to the floor system upon impact from above and a glide member in direct contact with the base, the glide members having a low coefficient of friction with respect to the base, thereby to enhance maneuverability and to facilitate interconnection of the floor sections.

12. The invention of claim 11 wherein each mount further comprises:

a resilient pad attached to the bottom surface of the respective floor section; and the respective glide member located at the bottom of the pad.

13. The invention of claim 11 wherein each mount further comprises:

encasement means carried by the bottom surface of each of the sections, the encasement means including a respective glide member in contact with the base; and a resilient pad held by the encasement means above the glide member.

14. The invention of claim 13 wherein each encasement means is partially embedded in the bottom surface of the respective floor section.

15. A portable floor module for interconnection with a plurality of other modules to form a portable floor:

a plurality of mounts attached to a bottom surface of the module for supporting the module in spaced relation above a base, and each of the mounts further including, resilient means to promote vertical deflection of the floor when impacted from above, a glide member which is substantially non-compressible under normal floor loading conditions, each of the glide members having a relatively low coefficient of friction with respect to the base, thereby to enhance maneuverability in positioning and aligning the module to facilitate interconnection with other modules to form the floor system.

16. A portable hardwood floor system adapted to overlay a substrate comprising:

a plurality of portable sections, each the sections including means adapted for operatively interconnecting the sections together to form an interconnected floor system and each of the sections including a bottom subfloor of elongated and spaced sleepers;

a plurality of mounts secured to a bottom surface of each of the sleepers for supporting the respective floor section in spaced relation above a base;

each of the mounts including a glide member which is substantially non-compressible under normal floor loading conditions, each of the glide members having a relatively low coefficient of friction with respect to the base, thereby to enhance maneuverability in positioning and aligning the sections to facilitate interconnection thereof to form the floor system; and a plurality of spacing blocks secured to the bottoms of the sections between the sleepers and oriented perpendicular with respect thereto, the spacing blocks of adjacently located floor sections of the floor system being staggered, whereby the sections may be stacked in an offset manner which eliminates compressive loading of the mounts during period of non-use.

17. The portable hardwood floor system of claim 16 wherein the mounts ar partially embedded in the bottom surface of the sleepers.

* * * * *